US009975229B2

(12) United States Patent
Haehndel et al.

(10) Patent No.: US 9,975,229 B2
(45) Date of Patent: May 22, 2018

(54) NAIL DRIVING DEVICE

(71) Applicant: ILLINOIS TOOL WORKS INC., Glenview, IL (US)

(72) Inventors: Olaf Haehndel, Plattensen (DE); Torsten Weigmann, Ronnenberg (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 631 days.

(21) Appl. No.: 14/398,135

(22) PCT Filed: May 2, 2013

(86) PCT No.: PCT/US2013/039244
§ 371 (c)(1),
(2) Date: Oct. 31, 2014

(87) PCT Pub. No.: WO2013/166273
PCT Pub. Date: Nov. 7, 2013

(65) Prior Publication Data

US 2015/0136827 A1 May 21, 2015

(30) Foreign Application Priority Data

May 3, 2012 (DE) ..... 20 2012 004 325

(51) Int. Cl.
*B25C 1/04* (2006.01)
*B25C 1/00* (2006.01)
*B25C 1/18* (2006.01)

(52) U.S. Cl.
CPC ..... *B25C 1/003* (2013.01); *B25C 1/04* (2013.01); *B25C 1/047* (2013.01); *B25C 1/184* (2013.01)

(58) Field of Classification Search
CPC ..... B25C 1/00; B25C 1/001; B25C 1/003; B25C 1/005; B25C 1/04; B25C 1/06; B25C 1/184
USPC ... 227/109, 119, 120, 130, 135, 136, 138, 8; 206/347, 338, 345, 382
See application file for complete search history.

(56) References Cited

U.S. PATENT DOCUMENTS 3,438,487 A 4/1969 Gallee et al.
3,543,987 A 12/1970 Obergfell et al.
4,014,488 A * 3/1977 Potucek ..... B25C 1/003 226/147

(Continued)

FOREIGN PATENT DOCUMENTS

AT 292289 B 8/1971
DE 3150414 C2 2/1987

(Continued)

OTHER PUBLICATIONS

ISR and WO for PCT/US2013/039244 dated Nov. 15, 2013.
German Search Report dated Jan. 29, 2013 for German Application No. 20 2012 004 325.0 filed May 3, 2012.

*Primary Examiner* — Scott A. Smith
(74) *Attorney, Agent, or Firm* — Hauptman Ham, LLP

(57) ABSTRACT

The invention is directed to a nail driving device, comprising a driving ram having a drive unit and a feed mechanism for a nail strip that is transportable in a transporting direction, wherein a guide member and/or a transporting member of the feed mechanism acts in operation on the receiving ribbon. It is proposed that the guide member and/or transporting member is formed to operate on receiving ribbons of different widths.

24 Claims, 6 Drawing Sheets

(56) References Cited

U.S. PATENT DOCUMENTS

| | | | | |
|---|---|---|---|---|
| 4,606,455 | A | 8/1986 | Grikis et al. | |
| 5,240,161 | A * | 8/1993 | Kaneko | B25C 1/003 227/109 |
| 5,738,266 | A | 4/1998 | Ogawa | |
| 5,803,338 | A * | 9/1998 | Singer | B25C 1/005 227/110 |
| 6,029,814 | A * | 2/2000 | Ohuchi | B21J 15/323 206/338 |
| 6,170,730 | B1 * | 1/2001 | Lin | B25C 1/003 227/119 |
| 6,308,880 | B1 | 10/2001 | Ronconi | |
| 6,679,414 | B2 * | 1/2004 | Rotharmel | B25C 1/184 227/119 |
| 6,763,991 | B2 | 7/2004 | Hamano | |
| 7,108,130 | B2 | 9/2006 | Herelier et al. | |
| 7,530,458 | B2 * | 5/2009 | Fujiyama | F16B 15/08 206/343 |
| 7,699,201 | B2 * | 4/2010 | Hagan | B25C 1/003 227/120 |
| 7,950,556 | B2 * | 5/2011 | Hagan | B25C 1/003 227/128 |
| 7,971,768 | B2 * | 7/2011 | Wywialowski | B25C 1/08 227/109 |
| 2002/0113114 | A1 * | 8/2002 | Hamano | B25C 1/003 227/156 |
| 2003/0075466 | A1 * | 4/2003 | Herelier | B25C 1/184 206/338 |

FOREIGN PATENT DOCUMENTS

| | | | |
|---|---|---|---|
| DE | 69618701 | T2 | 9/2002 |
| DE | 60212031 | T2 | 1/2007 |
| EP | 0739690 | A1 | 10/1996 |
| EP | 0928666 | A2 | 7/1999 |
| EP | 1232837 | A2 | 8/2002 |
| EP | 1304490 | A1 | 4/2003 |

* cited by examiner

NAIL DRIVING DEVICE

RELATED APPLICATIONS

The present application is a National Phase of International Application Number PCT/US2013/039244 filed May 2, 2013 and claims priority to German Application Number 20 2012 004 325.0 filed May 3, 2012.

The invention relates to a nail driving device according to the preamble of claim 1.

U.S. Pat. No. 4,606,455 discloses a coilable nail strip, in which a carrier strip is in the form of a flat, segmented plastics strip. Each segment has a central part having an aperture, wherein end-side tabs adjoin the central part and are bent up through 90°. The fastening members, for example nails, are plugged into retaining slots in the tabs. Nail strips of this design are available on the market in various conventional sizes. Common designations for various sizes of the plastics strips are marketed, for example, under the trademark DUO-FAST® as IN strips, CL strips or GN strips.

It is the object of the invention to specify a nail driving device which allows great versatility with respect to the nail strips used.

For an initially mentioned nail driving device, this object is achieved according to the invention by way of the characterizing features of claim 1. As a result of the configuration according to the invention of the feed mechanism, it is possible, with a simple structural design, to use different receiving ribbons of the first and second types, in particular receiving ribbons having first and second widths, as carriers for the nails, this resulting in a broader range of uses of the nail driving device.

Previously, it was in principle necessary to use, for each type or size of receiving ribbon, a device specifically designed therefor. Only in this way is sufficient guiding ensured in the known devices, in particular with regard to the support of the bottom edge of the receiving ribbon emerging from the device. This support is relevant in particular for the manual tearing off, carried out predominantly from top to bottom, of that part of the receiving ribbon that has already emerged. Specifically, if there is no such support of the bottom edge, the tearing-off from top to bottom has a negative effect on the positioning of the receiving ribbon located in the device, i.e. on the positioning of the nails located in the device, and this can impair the driving operation.

Although nail driving devices which can be set manually to different widths of receiving ribbons are known, the adjustability relates only to the guiding of the receiving ribbon within the device and does not guarantee supporting of the bottom edge of the emerging receiving ribbon. In addition, the adjustability is complex in terms of design and not very convenient to use.

As a result of the insertion, according to the invention, of the top edge of the receiving ribbon in different positions, it is possible in principle to dispense with mechanical adjustment of the device and with the associated complexity in terms of design. With a corresponding configuration, it is thus possible for example for the bottom edge of the receiving ribbon, with corresponding insertion of the receiving ribbon in the driving direction, always to be positioned in the same way.

Since, according to the invention, it is possible to use at least two different receiving ribbons, it is possible for example to increase the range of lengths of nails that can be used. For example, nails having a length in the range of 30 mm to 90 mm can be used with a device according to the invention.

Within the meaning of the invention, a nail should be understood as being any fastening means which can be driven by way of a conventional nail driving device or is previously known in conjunction with receiving ribbons. These include not only nails proper, but also screws or the like. The driving operation is in this case limited not just to linear movements, but can in principle also comprise a rotation or screwing-in movement of the fastening means.

Within the meaning of the invention, the transporting member should be understood as being any element of the feed mechanism that is driven in order to move the receiving ribbon. Within the meaning of the invention, the guide member should be understood as being an element of the feed mechanism that is stationary during transport and acts on the receiving ribbon in a guiding manner. The transporting member and/or guide member can be formed in each case in a one-part or multi-part manner. A device according to the invention can have both members, i.e. the specifically designed guide member and specifically designed transporting member, or only one of the two.

The receiving ribbons or nail strips can be essentially previously known products or products available on the market. Depending on the configuration of the invention, these can be used in an identical manner or with minor modifications. If modifications are carried out, then it is preferred within the meaning of the invention if the modified nail strips can still be used with conventional nail driving devices.

In a generally advantageous manner, the second width is at least 20%, preferably at least 30%, smaller or larger than the first width. In this way, a particularly large range of fastening means that can be received by the receiving ribbons can be covered.

In a preferred embodiment of the invention, the guide member has a mask extending in particular transversely to the transporting direction. Particularly preferably, in this case a first mask opening serves only for guiding the receiving ribbon of the first type and a second mask opening serves only for guiding the receiving ribbon of the second type.

In an advantageous development of a mask, the receiving ribbons each comprise a central part having laterally adjoining bent-up tabs for holding the nails, wherein at least one of the tabs is bent in a portion of the mask during ribbon transport.

In an alternative or supplementary embodiment, the transporting member comprises a driver that is moved in the transporting direction, such that the receiving ribbon is advanced in a simple manner by interaction with the receiving ribbon and displacement of the driver.

A particularly effective configuration of the driver can consist in that the driver has a first driver claw and at least one second driver claw, wherein preferably the driver claws are spaced apart in the driving direction of the nails. Advantageously, to this end the receiving ribbons have transporting openings, wherein both driver claws engage in the transporting opening of the receiving ribbon of the first type, and wherein only one of the driver claws engages in the transporting opening of the receiving ribbon of the second type. In principle, however, it may also be advantageous to provide a single driver claw, which is positioned precisely such that it can be brought into engagement with the receiving ribbons of both widths.

In the interests of improved kinetics of the feed mechanism, it is provided for the driver to be formed in an elastically resilient manner at least during a part of its movement. As a result, it can yield to the receiving ribbon, for example during a return movement, such that friction and deformation of the receiving ribbon by the driver are reduced.

In alternative embodiments of the invention, it is also possible however to provide means which do not act on the receiving ribbon but rather, for example, on the nails.

In a generally preferred manner, it is provided for an angle between the transporting direction and the width direction, i.e. in the driving direction of the nails, of the receiving ribbon to be substantially 90°. On account of the straight-line feeding of the nail strip, such arrangements are also known as "0° nail strips". In another variant, the angle between the transporting direction and the width direction has a different angle therefrom, in particular an angle of substantially 16°.

Further advantages and features of the invention can be gathered from the exemplary embodiments described in the following text and also from the dependent claims.

A preferred exemplary embodiment of the invention is described in the following text and explained in more detail with reference to the appended drawings.

Figure 1:
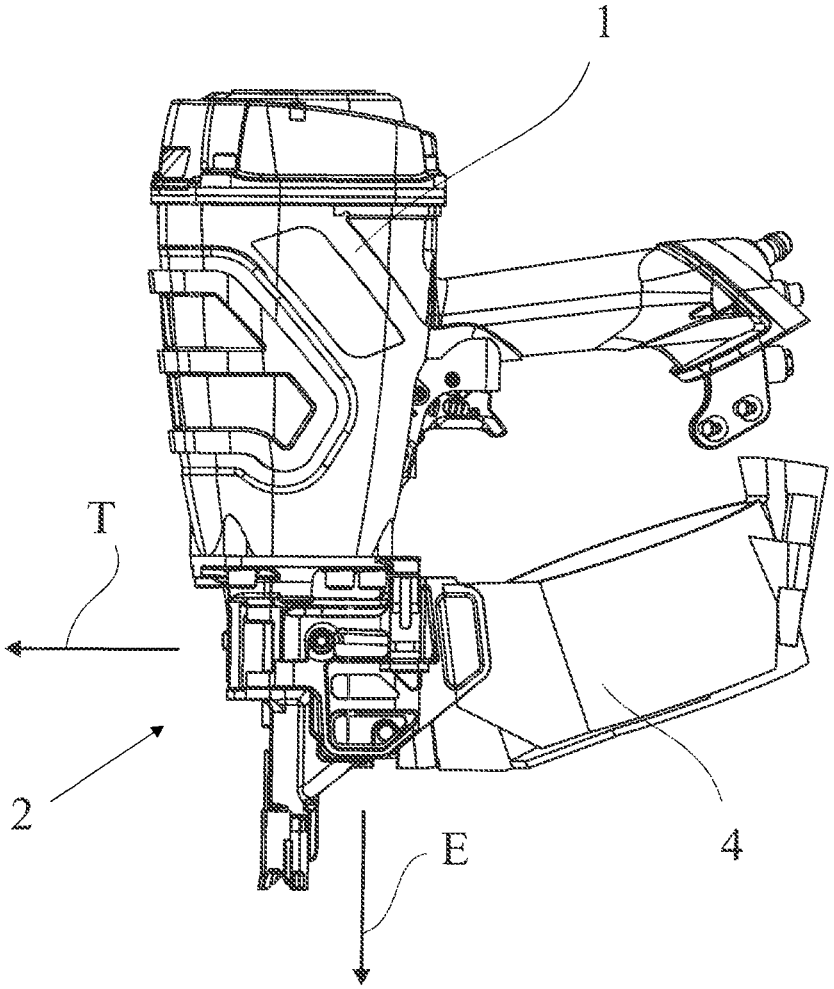
FIG. 1 shows a lateral plan view of a nail driving device according to the invention.

The nail driving device according to the invention, which is shown in FIG. 1, is formed in the present case as a device that is operated using compressed air. A drive unit 1 having a handle is connectable to a compressed-air line. Arranged in a front region of the drive unit 1 is a feed mechanism in which a nail strip 3 (see for instance FIG. 5, FIG. 6) is fed. The nail strip 3 is rolled up as a supply in a drum-like magazine housing 4 and is pulled out of the magazine 4 in a known manner by the feed mechanism during transport.

Figure 5:
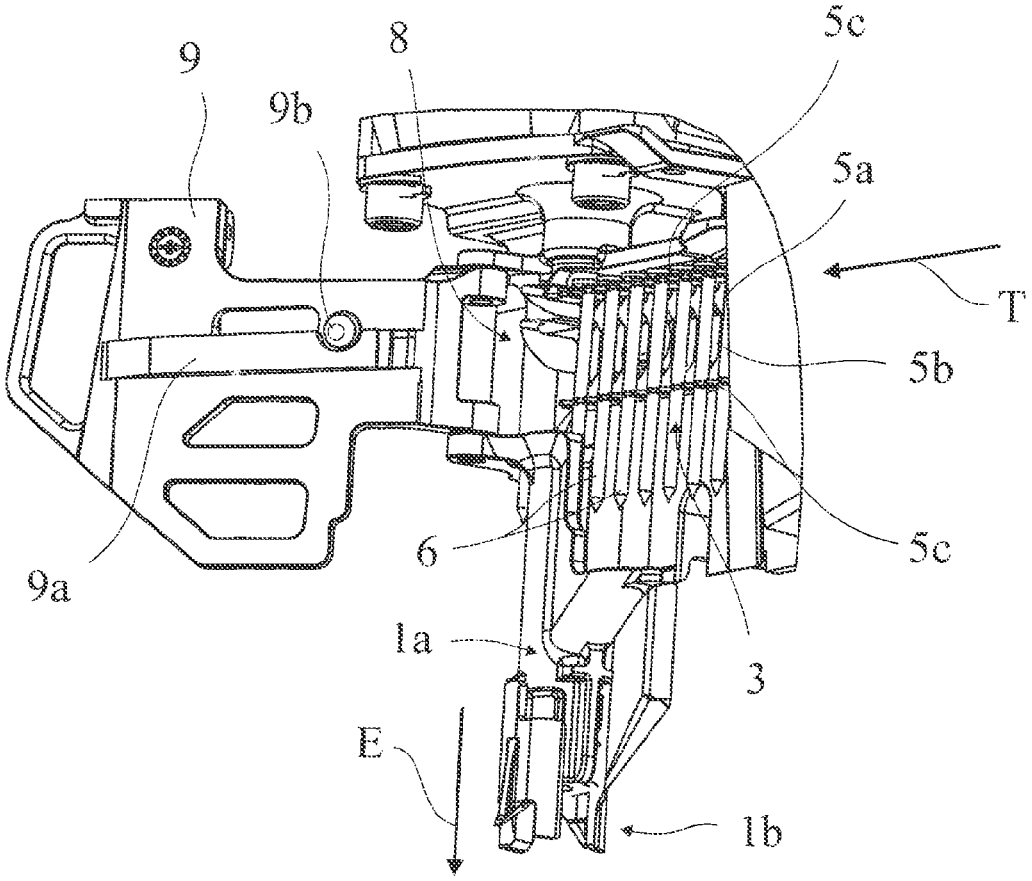
FIG. 5 shows the view from FIG. 4 with a nail strip of the first type inserted.
Figure 6:
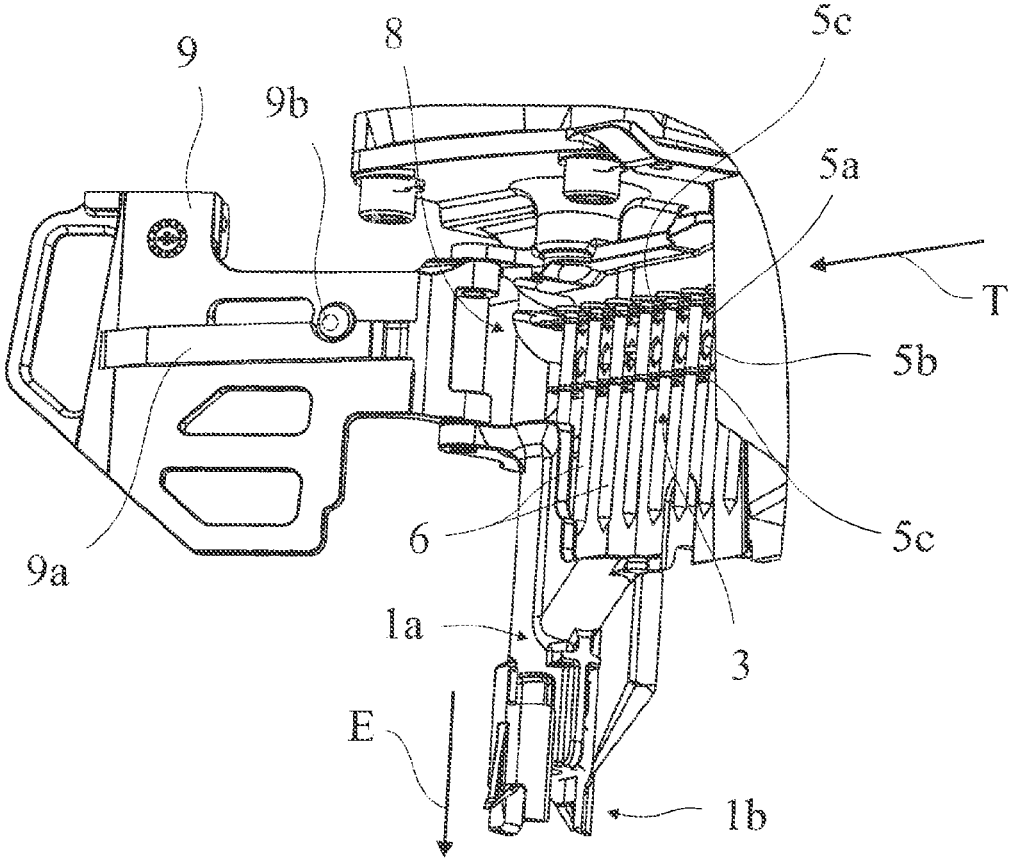
FIG. 6 shows the view from FIG. 4 with a nail strip of the second type inserted.

In the present case, the nail strips 3 comprise receiving ribbons 5, the basic design of which is explained for example in document U.S. Pat. No. 4,606,455. They are punched in principle out of a flat plastics strip and have a central region 5*a* which is segmented by transport holes 5*b* at the spacing of successive nails 6. The segments of the central region 5*a* are adjoined on both sides in each case by tabs 5*c*, into which slot-like, outwardly open recesses are introduced. The nails 6 of the nail strips 3 are held in that a respective nail 6 is latched into the recesses of the in each case two tabs 5*c* of a segment of the central region 5*a*, see for instance FIG. 5 and FIG. 6. FIG. 5 and FIG. 6 show two different types of receiving ribbons 5, which have different widths in the transverse direction. The wider receiving ribbon (FIG. 5) has here a width of around 25 mm and the narrower receiving ribbon (FIG. 6) has here a width of approximately 15 mm.

In a central region of the feed mechanism, a driving ram (not illustrated) drives a nail 6, which is positioned in each case in an appropriate manner, through a guide tube 1*a* which is placed on a workpiece in order to position the nail. A securing sleeve 1*b* at the end of the guide tube 1*a* is in this case pushed in and releases the drive mechanism in a known manner. The driving ram then pushes the nail 6 into the guide tube 1*a*, with the nail 6 being removed from the elastic plastics tab 5*c*. Finally, the nail 6 is driven into the workpiece in question in the driving direction E.

In the feed mechanism, further developments according to the invention were carried out in the present case, said further developments allowing the device to be used with nail strips 3 or receiving ribbons 5 having different sizes, in particular different widths. An example of a commercially customary device which is designed only for use with receiving ribbons 5 having a particular width is marketed under the name "PASLODE® PF237C".

In the feed mechanism according to the invention, a nail strip 3 is advanced in its longitudinal direction or in the transporting direction T, with the nails 6 being oriented through 90° thereto in a transverse direction.

Depending on the type of receiving ribbon 5, the top edge of the receiving ribbon 5 is positioned in operation in different positions in the feed mechanism with respect to the driving direction E. The indication "top" refers here to a height direction in the driving direction E, with the driving direction E being directed from top to bottom in the present sense. The positioning of the receiving ribbons 5 is revealed by viewing FIGS. 5 and 6 together. The top edge of the receiving ribbon 5 of the first type that is illustrated in FIG. 5 is located higher up than the top edge of the receiving ribbon 5 of the second type that is illustrated in FIG. 6. The respective positioning of the receiving ribbon 5 results from the corresponding introduction of the receiving ribbon 5 into a mask 7 that will be explained in the following text. As a result of the different positioning of the top edges of the different receiving ribbons 5, it is possible for the bottom edge of the receiving ribbons 5 always to be positioned at the same height, in a manner yet to be explained.

Downstream of the driving position in the transporting direction T, the receiving ribbon 5 is transported on without held nails 6 and passes through the exit-side mask 7. The mask 7 has a first mask opening 7*a* and a second mask opening 7*b* that is spaced apart therefrom in the driving direction E. The mask openings 7*a*, 7*b* are in the form of slots and extend in a transverse direction perpendicular to the transporting direction T and the driving direction E. The positions of the mask openings 7*a*, 7*b* in the driving direction E determine the corresponding position of the receiving ribbon 5.

Depending on the used receiving ribbon 5 of the first type (see FIG. 5) having a first width, the upper of the two tabs 5*c* of a segment is guided only through the first mask opening 7*a*. In the case of the receiving ribbon 5 of the second type (see FIG. 3, FIG. 6) having a width which is different therefrom, in the present case a smaller width, the upper tab 5*c* is guided only through the second mask opening 7*b*.

Figure 4:
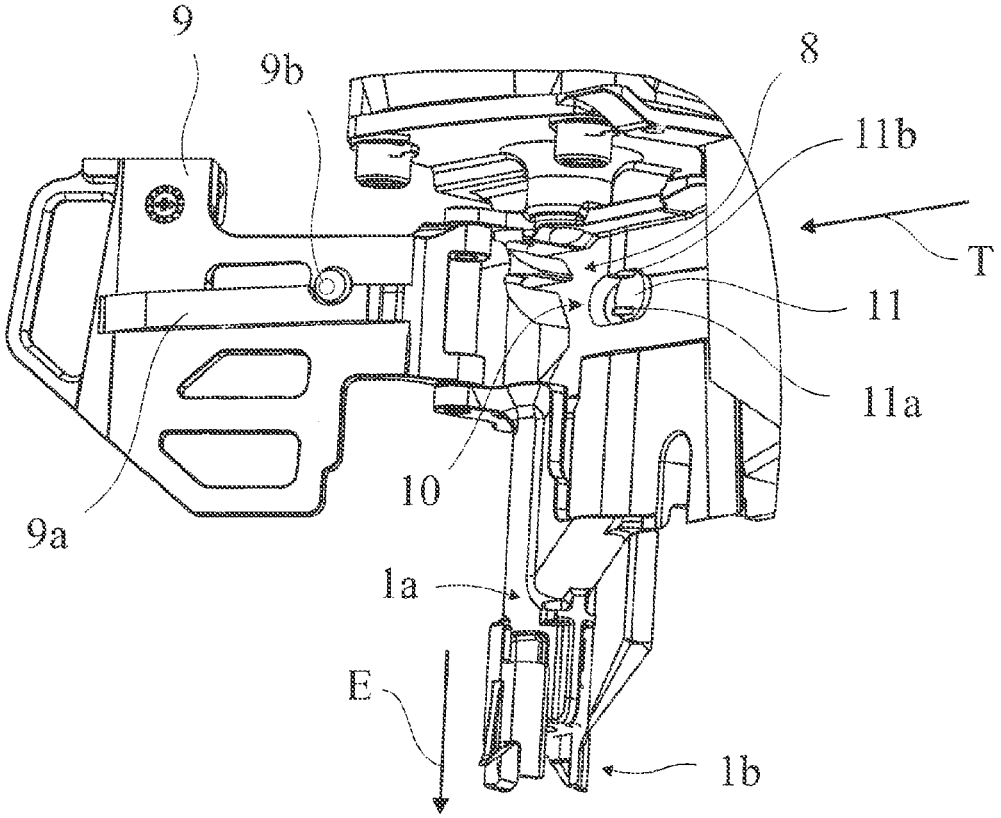
FIG. 4 shows a three-dimensional view of a detail of the nail driving device from FIG. 1 with the feeding area open.

As is clear in particular from FIG. 4 to FIG. 6, the mask openings 7*a*, 7*b* have in each case bevels on the entry side, by means of which bevels the mounting of the tabs 5*c* is improved.

The two mask openings 7*a*, 7*b* open in each case in a slot-like third mask opening 7*c* extending in each case transversely thereto or in the driving direction E. The central part 5*a* and the other, lower tab 5*c* of the respective receiving ribbon 5 emerge in each case from the third mask opening 7*c*. To this end, the lower tab 5*c* is bent through 90° by a corresponding bevel upon entering the mask opening 7*c*, such that it lies in a plane with the central part 5*a*.

Figure 2:
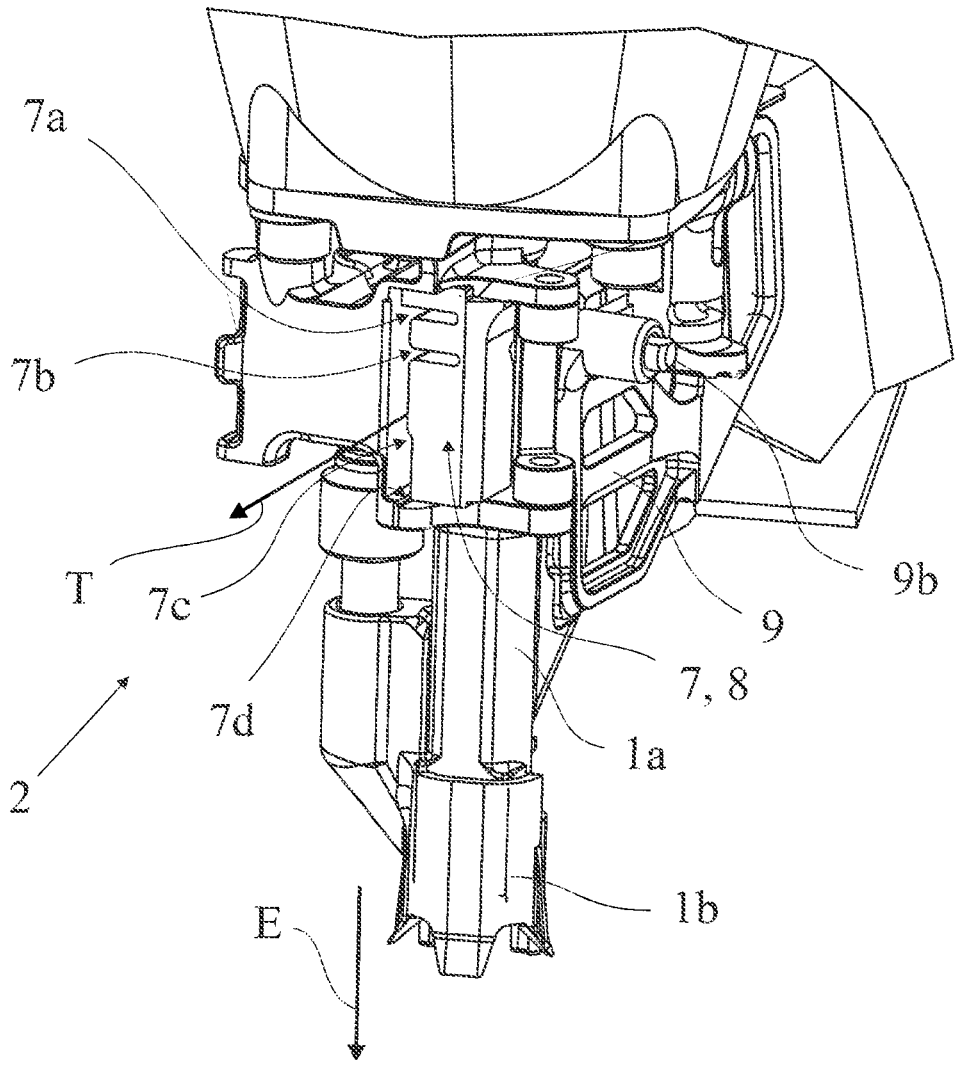
FIG. 2 shows a three-dimensional view of a detail of the nail driving device from FIG. 1.
Figure 3:
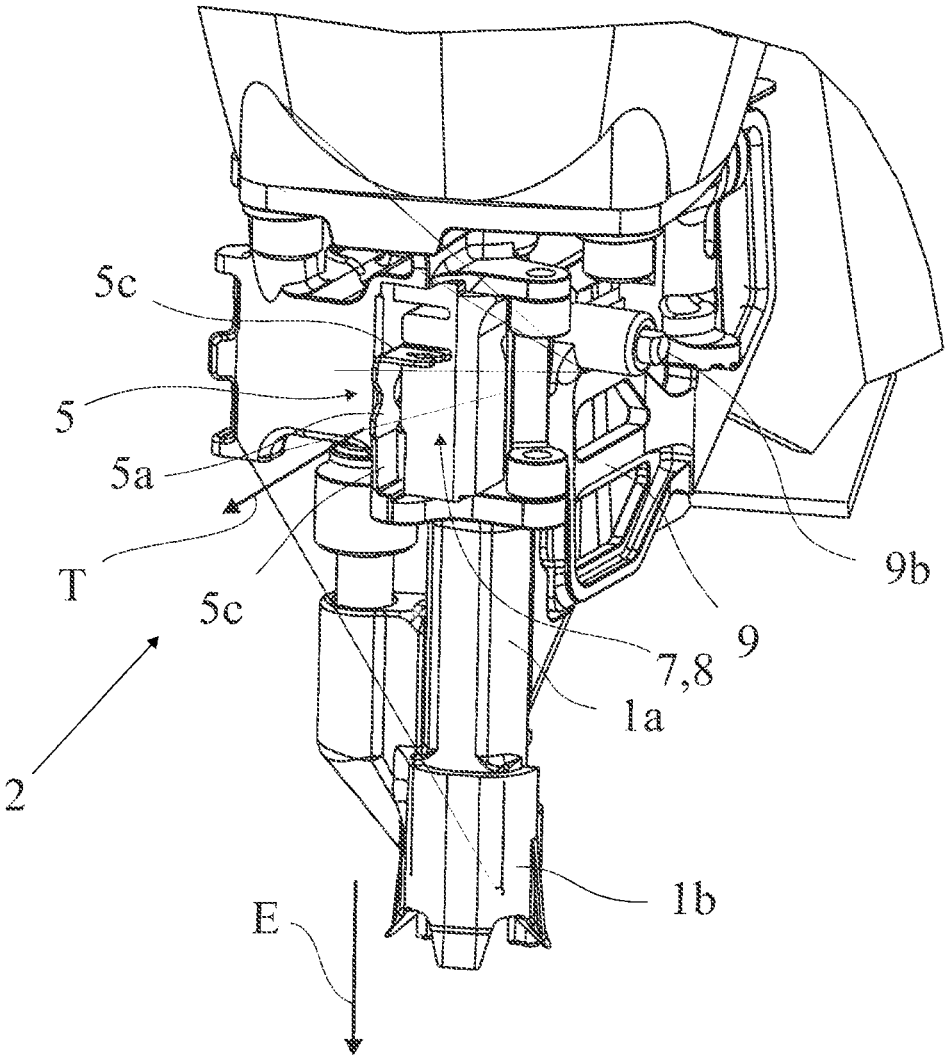
FIG. 3 shows the view from FIG. 2 with an inserted nail strip.

FIG. 2 shows that the first mask opening 7*a* and second mask opening 7*b* form here, and preferably together with at least one portion of the third mask opening 7*c*, two substantially L-shaped mask opening regions of the first type and second type, which serve for the emergence of the receiving ribbons 5 of the first type and second type. FIG. 3 shows the emergence of a receiving ribbon 5 of the second type from the mask opening region of the second type. It is also clear from this illustration that the receiving ribbons 5 of the first type and second type are in substantially form-fitting engagement with the corresponding, L-shaped mask opening portions.

In the case of the exemplary embodiment which is illustrated and is to this extent preferred, it is the case that the L-shaped mask opening regions each have a limb 7*c* that extends substantially parallel to the driving direction E and the length of which corresponds substantially to the length of the limb that emerges there (consisting here of the central part 5*a* and the lower, bent tab 5*c*) of the associated receiving ribbon 5. This adaptation of the dimension of the respective mask opening portion to the dimension of the respective receiving ribbon 5 is particularly advantageous with regard to tearing the empty part, which has emerged from the mask 7, of the receiving ribbon 5 off that part of the receiving ribbon 5 that is located in the mask 7.

Tearing off the free part of the receiving ribbon 5 is a simple variant for removing the disruptive part, which has emerged from the mask 7, of the receiving ribbon 5. This tearing off is carried out predominantly by way of a sudden exertion of force on the free end of the receiving ribbon 5 in the driving direction, i.e. from top to bottom in FIG. 3. As a result of the above adaptation of the dimensions in question, particularly good support of the, in FIG. 3, bottom rim of the receiving ribbon 5 is achieved during the tearing-off thereof. As a result, the tearing-off operation scarcely has a negative effect on the positioning of the receiving ribbon 5 located in the device and thus on the nails 6 located in the device.

In a very general manner, a particularly advantageous tearing-off operation is achieved in that the bottom edge of the receiving ribbon 5 emerging from the mask 7 is always positioned in the same way with respect to the driving direction E, irrespective of the type of receiving ribbon 5. In this case, the bottom edge is supported here and preferably by the shoulder 7*d* illustrated in FIG. 2.

In the illustrations in FIG. 4 to FIG. 6, a closure cap 9 of the feed mechanism is located for illustrative purposes in an open state. The other figures show the closure cap 9 in each case in the closed or operational state.

Arranged in the closure cap 9 is a guide rail 9*a* that rests on the nails 6. Also provided is a spring catch 9*b* that partially overlaps the guide rail 9*a* and has a rounded, in the present case hemispherical head 9*b*. The resiliently mounted head 9*a* is in each case deflected in the driving position of a nail 6 and is located between two successive nails 6. This ensures that pressure is applied to the nail strip 3 and additionally that the nails 6 are positioned in the transporting direction T.

The nail strip 3 is transported by way of a driver 11 (see FIG. 4) which is moved back and forth in the transporting direction T by the compressed-air-driven drive of the device. The driver 11 has two driver claws 11*a*, 11*b*, which are spaced apart in the transverse direction and each have the form of a catch having an inclined ramp.

As a comparison of FIG. 5 and FIG. 6 shows, in the case of the wider receiving ribbon (FIG. 5) both driver claws 11*a*, 11*b* engage in the transport hole of the central part 5*a* of the receiving ribbon 5. In the case of the narrower ribbon (see FIG. 6), only one of the two driver claws 11*a* engages in the transport hole, while the second driver claw 11*b* runs directly along the external rim of the receiving ribbon 5.

During a return movement of the driver claw 11, the inclined ramps slide through under the central part 5*a* of the respective receiving ribbon 5, with the driver 11 additionally yielding in the transverse direction on account of its resiliently elastic mounting.

When the driver 11 moves in the transporting direction T, perpendicular flanks of the driver claws 11*a*, 11*b* mesh with the transport holes 5*b* of the receiving ribbons, such that the latter are advanced in the transporting direction T by one nail unit.

A comparison of FIG. 5 and FIG. 6 also shows that the heads of the nails 6 are arranged in different positions in the driving direction E in accordance with the different widths of the receiving ribbons 5.

The invention claimed is:

1. A nail driving device, comprising a driving ram having a drive unit and a feed mechanism for a nail strip that is transportable in a transporting direction, wherein the nail strip comprises a receiving ribbon of a first type, which holds nails and has a first width measured in a driving direction of the nails, and wherein a guide member and/or a transporting member of the feed mechanism acts in operation on the receiving ribbon, wherein the guide member and/or transporting member is additionally formed to act during operation on a nail strip having a receiving ribbon of a second type, wherein a width of the receiving ribbon of the second type has a second defined width which is different from the first width, wherein, in operation, top edges of the receiving ribbons of the first type and the second type are in different positions in the feed mechanism with respect to the driving direction, the transporting member comprises a driver that is moved in the transporting direction, the driver has a first driver claw and at least one second driver claw, wherein in particular the driver claws are spaced apart in a width direction, and the receiving ribbons have transporting openings, wherein both driver claws engage in the transporting opening of the receiving ribbon of the first type, and wherein only one of the driver claws engages in the transporting opening of the receiving ribbon of the second type.

2. The nail driving device as claimed in claim 1, wherein bottom edges of the receiving ribbons of the first type and the second type are in identical positions with respect to the driving direction.

3. The nail driving device as claimed in claim 1, wherein the second width is at least 20%, smaller or larger than the first width.

4. The nail driving device as claimed in claim 1, wherein the guide member comprises a mask extending in particular transversely to the transporting direction, preferably in that the receiving ribbon emerges without held nails from the mask downstream of a driving position in the transporting direction.

5. The nail driving device as claimed in claim 4, wherein a first mask opening serves only for guiding the receiving ribbon of the first type and a second mask opening serves only for guiding the receiving ribbon of the second type.

6. The nail driving device as claimed in claim 5, wherein the first mask opening and second mask opening, preferably together with at least a portion of a third mask opening, form substantially L-shaped mask opening regions of the first type and second type for the emergence of the receiving ribbons corresponding to the first type and second type.

7. The nail driving device as claimed in claim 6, wherein the receiving ribbons of the first type and second type are in substantially form-fitting engagement with the corresponding L-shaped mask opening region.

8. The nail driving device as claimed in claim 6, wherein the L-shaped mask opening regions each have a limb extending substantially parallel to the driving direction, the length of said limb corresponding substantially to the length of the limb, that emerges there, of the associated receiving ribbon.

9. The nail driving device as claimed in claim 4, wherein the receiving ribbons each comprise a central part having laterally adjoining bent-up tabs for holding the nails.

10. The nail driving device as claimed in claim 1, wherein the driver is formed in an elastically resilient manner at least during a part of its movement.

11. The nail driving device as claimed in claim 1, wherein the second width is at least 30% smaller or larger than the first width.

12. An assembly, comprising:

a nail driving device, including:

a driving ram having a drive unit and a feed mechanism for a nail strip that is transportable in a transporting direction, wherein the nail strip comprises a receiving ribbon of a first type, which holds nails and has a first width measured in a driving direction of the nails, and wherein the nail driving device is configured to receive the receiving ribbon of the first type, wherein the feed mechanism includes a guide member and a transporting member, and wherein at least one of the guide member or the transporting member is configured to act in operation on the receiving ribbon, wherein at least one of the guide member or the transporting member is further configured to act during operation on a nail strip having a receiving ribbon of a second type, wherein a width of the receiving ribbon of the second type has a second defined width which is different from the first width, wherein, the nail driving device is configured such that, in operation, top edges of the receiving ribbons of the first type and the second type are in different positions in the feed mechanism with respect to the driving direction, the transporting member comprises a driver that is moved in the transporting direction, the driver has a first driver claw and at least one second driver claw, wherein in particular the driver claws are spaced apart in a width direction, and the receiving ribbons have transporting openings, wherein both driver claws engage in the transporting opening of the receiving ribbon of the first type, and wherein only one of the driver claws engages in the transporting opening of the receiving ribbon of the second type.

13. The assembly of claim 12, further comprising:

the receiving ribbon of the second type, wherein the receiving ribbon of the second type is loaded into the nail driving device and is interfacing with at least one of guide member or the transporting member.

14. The assembly as claimed in claim 13, wherein bottom edges of the receiving ribbons of the first type and the second type are in identical positions with respect to the driving direction.

15. The assembly as claimed in claim 13, wherein the second width is at least 20%-smaller or larger than the first width.

16. The assembly as claimed in claim 13, wherein the guide member comprises a mask extending in transversely to the transporting direction, and is configured such that the receiving ribbon emerges without held nails from the mask downstream of a driving position in the transporting direction during operation.

17. The assembly claimed in claim 16 wherein a first mask opening serves only for guiding the receiving ribbon of the first type and a second mask opening serves only for guiding the receiving ribbon of the second type.

18. The assembly as claimed in claim 17, wherein the first mask opening and second mask opening, preferably together with at least a portion of a third mask opening, form substantially L-shaped mask opening regions of the first type and second type for the emergence of the receiving ribbons corresponding to the first type and second type.

19. The assembly as claimed in claim 17, wherein the receiving ribbons of the first type and second type are in substantially form-fitting engagement with the corresponding L-shaped mask opening region.

20. The assembly as claimed in claim 17, wherein the L-shaped mask opening regions each have a limb extending substantially parallel to the driving direction, the length of said limb corresponding substantially to the length of the limb, that emerges there, of the associated receiving ribbon.

21. The assembly as claimed in claim 16, wherein the receiving ribbons each comprise a central part having laterally adjoining bent-up tabs for holding the nails.

22. The assembly as claimed in claim 13, wherein the second width is at least 30% smaller or larger than the first width.

23. The assembly as claimed in claim 22, further comprising the first strip.

24. The assembly as claimed in claim 12, wherein the driver is formed in an elastically resilient manner at least during a part of its movement.

* * * * *